US007617942B2

(12) United States Patent
Albanese

(10) Patent No.: US 7,617,942 B2
(45) Date of Patent: Nov. 17, 2009

(54) JEWELRY ORGANIZER

(76) Inventor: Alison Albanese, 236 Fremont St., Apt. 2f, Harrisson, NY (US) 10528-4013

( * ) Notice: Subject to any disclaimer, the term of this patent is extended or adjusted under 35 U.S.C. 154(b) by 288 days.

(21) Appl. No.: 11/357,239

(22) Filed: Feb. 17, 2006

(65) Prior Publication Data

US 2007/0193969 A1 Aug. 23, 2007

(51) Int. Cl.
*A47F 7/02* (2006.01)

(52) U.S. Cl. ..... 211/85.2

(58) Field of Classification Search ..... 211/85.2, 211/13.1, 119.009, 181.1; 206/6.1, 495, 206/566, 806; D6/467, 445
See application file for complete search history.

(56) References Cited

U.S. PATENT DOCUMENTS

| | | | | | |
|---|---|---|---|---|---|
| 626,739 | A | * | 6/1899 | Vanderman | 211/119.009 |
| 1,274,172 | A | * | 7/1918 | Lee | 211/106 |
| 2,903,227 | A | | 9/1959 | Key | |
| 3,339,745 | A | * | 9/1967 | Sugerman | 211/85.2 |
| 3,608,991 | A | | 9/1971 | Wade | |
| 3,789,996 | A | * | 2/1974 | Stroh | 211/119 |
| 4,264,013 | A | * | 4/1981 | Vollmer | 211/85.2 |
| D291,641 | S | * | 9/1987 | Farley | D6/566 |
| 4,767,011 | A | * | 8/1988 | Butler | 211/85.2 |
| 4,775,053 | A | | 10/1988 | Geiger | |
| 4,819,817 | A | | 4/1989 | Mar | |
| 4,966,287 | A | * | 10/1990 | Snyder | 211/85.2 |
| 5,052,563 | A | * | 10/1991 | Camp | 211/85.2 |
| 5,242,048 | A | * | 9/1993 | Ellingsworth et al. | 206/6.1 |
| D345,070 | S | * | 3/1994 | Warren | D6/570 |
| 5,318,175 | A | | 6/1994 | Stevens | |
| 5,427,230 | A | | 6/1995 | Mattox | |
| D362,777 | S | * | 10/1995 | Emery et al. | D6/566 |
| D368,583 | S | * | 4/1996 | Sharer et al. | D3/294 |
| D370,139 | S | * | 5/1996 | Chaparro et al. | D6/466 |
| D372,391 | S | * | 8/1996 | Anniballi | D6/570 |
| 5,588,543 | A | * | 12/1996 | Finger | 211/90.01 |
| 5,645,178 | A | | 7/1997 | Conley, Jr. | |
| D395,768 | S | * | 7/1998 | Greiner | D6/436 |
| 5,950,815 | A | * | 9/1999 | Yetman-Bellows | 206/6.1 |
| 5,957,308 | A | | 9/1999 | Zierenberg | |
| D416,736 | S | * | 11/1999 | Bergin | D6/559 |
| D430,755 | S | * | 9/2000 | Simmons | D6/470 |
| D473,411 | S | * | 4/2003 | Walker | D6/525 |

(Continued)

*Primary Examiner*—Sarah Purol
(74) *Attorney, Agent, or Firm*—Michael A. Blake

(57) ABSTRACT

A jewelry organizer comprising: two vertical members; a plurality of wire shelves in communication with the two vertical members; a plurality of ring/broach hooks in communication with at least one of the plurality of wire shelves; a plurality of bracelet hooks in communication with at least one of the plurality of wire shelves; and an earring mount in communication with at least one of the plurality of wire shelves. A jewelry organizer comprising: a central member comprising: a spring loaded telescoping member; a loaded member; a wire rack assembly in communication with the central member, the wire rack assembly comprising: a wire rack vertical member; at least one ring/broach shelf in communication with the wire rack vertical member; a plurality ring/broach hooks in communication with the at least one ring/broach shelf; a necklace hook in communication with the wire rack vertical member; an earring rack assembly in communication with the central member, the earring rack comprising: at least one earring mount, the at least one earring mount comprising: an earring mount vertical member; and a sheet of material with perforations in communication with the earring mount vertical member.

7 Claims, 5 Drawing Sheets

U.S. PATENT DOCUMENTS

| | | | | | |
|---|---|---|---|---|---|
| D474,352 | S | * | 5/2003 | Shepard | D6/453 |
| 6,581,790 | B1 | * | 6/2003 | Zadro | 211/119 |
| D489,207 | S | * | 5/2004 | Rosen | D6/525 |
| D494,779 | S | * | 8/2004 | Wenger | D6/468 |
| D510,209 | S | * | 10/2005 | Martinelli | D6/468 |
| D532,217 | S | * | 11/2006 | Anderson | D6/467 |
| D563,694 | S | * | 3/2008 | Mitchell | D6/467 |
| 2004/0164037 | A1 | | 8/2004 | Phillips | |
| 2007/0193969 | A1 | * | 8/2007 | Albanese | 211/85.2 |

* cited by examiner

JEWELRY ORGANIZER

TECHNICAL FIELD

The present invention relates generally to holders for small items, and more particularly to holders for displaying and organizing jewelry.

BACKGROUND

Jewelry is typically stored in a jewelry box or in a drawer. As a result, the jewelry may become tangled, and particular items of jewelry may be difficult to locate. Additionally, these storage methods make it difficult for jewelry owners to evaluate their options when selecting or itemizing jewelry.

Prior attempts to organize jewelry have been numerous but inadequate. Currently available jewelry holders include a rigid plastic member having holes to accommodate pierced earrings, and rigid plastic members having U-shaped slots to hold necklaces. Additionally, jewelry holders having a series of pouches are commercially available, however, it is difficult for the jewelry owner to clearly see the contents of each pouch, even when the pouch is made of a clear plastic material. The pouches are particularly unsuitable for small or dainty jewelry, such as small earrings. These items become "lost" in the relatively large pouch and are difficult if not impossible to see. Furthermore, certain jewelry can become tangled within the pouch.

The difficulties with prior jewelry holders are that they are unable to accommodate all different types of jewelry, and they are unable to display the jewelry in such a manner so that the jewelry owner can see everything. Being able to clearly view all items of jewelry is important, so that the jewelry owner does not overlook an item in the jewelry collection, and so that the different items of jewelry may be coordinated depending upon the particular outfit worn, or the jewelry owner's preference on that particular day.

Thus, there is a need for a jewelry organizer that addresses these and other problems associated with currently available jewelry containers.

SUMMARY

The disclosed invention relates to a jewelry organizer comprising: two vertical members; a plurality of wire shelves in communication with the two vertical members; a plurality of ring/broach hooks in communication with at least one of the plurality of wire shelves; a plurality of bracelet hooks in communication with at least one of the plurality of wire shelves; and an earring mount in communication with at least one of the plurality of wire shelves.

The disclosed invention also relates to a jewelry organizer comprising: a central member comprising: a spring loaded telescoping member; a loaded member; a wire rack assembly in communication with the central member, the wire rack assembly comprising: a wire rack vertical member; at least one ring/broach shelf in communication with the wire rack vertical member; a plurality ring/broach hooks in communication with the at least one ring/broach shelf; a necklace hook in communication with the wire rack vertical member; an earring rack assembly in communication with the central member, the earring rack comprising: at least one earring mount, the at least one earring mount comprising: an earring mount vertical member; and a sheet of material with perforations in communication with the earring mount vertical member.

In addition, the disclosed invention also relates to a jewelry organizer comprising: at least one vertical member; a fanciful shaped earring mount in communication with the at least one vertical member, the fanciful shaped earring mount comprising: a fanciful shaped sheet of material with perforations; a necklace/bracelet hook in communication with the at least one vertical member an upper wall mount in communication with the at least one vertical member; and a lower wall mount in communication with the at least one vertical member.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
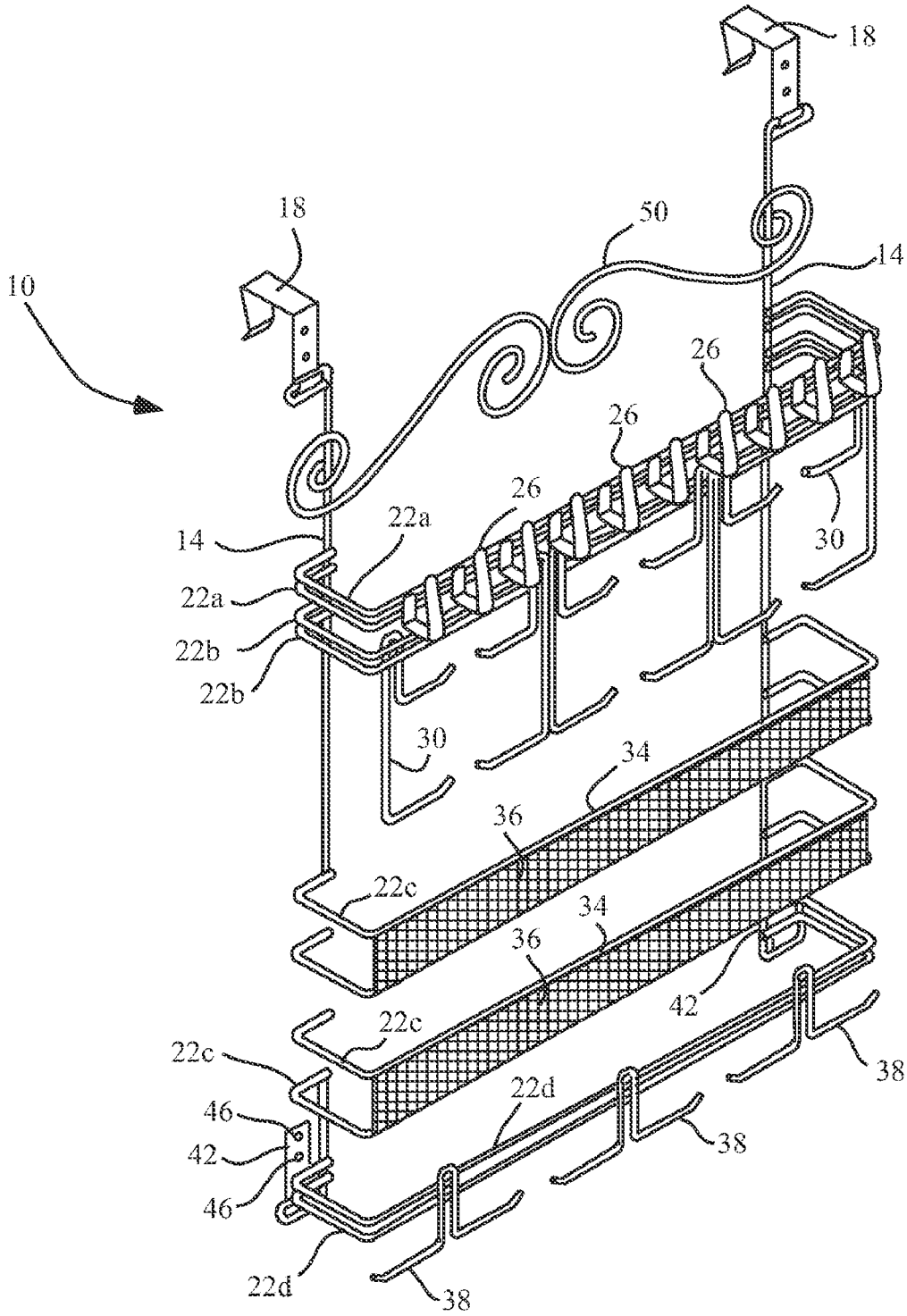
FIG. 1 is a perspective view of one embodiment of the disclosed jewelry organizer.

FIG. 1 is a perspective view of one embodiment of the disclosed jewelry organizer 10. The jewelry organizer has two vertical members 14. In communication with the two vertical members, are door hooks 18. The door hooks 18 are configured to slide over the top of a door. Holes may be located in the door hooks 18 in order to allow a user to use screws to firmly attach the door hooks to the door. In other embodiments, the door hooks 18 may be replaced by flat wall mounts, similar to the wall mounts 42 described below. Also in communication with the two vertical members 14, are a plurality of wire shelves 22. One or more wire shelves 22*a* may be used to communicate with a plurality of ring/broach hooks 26. One or more wire shelves 22*b* may be used to communicate with one or more bracelet hooks 30. One or more wire shelves 22*c* may be used to communicate with one or more earring mounts 34. The earring mounts 34 comprise a sheet of material 36 with perforations. Thus a user can attach her earrings to the earring mount by inserting the post of an earring into a perforation, and attaching the back of the earring to the post, thus allowing the sheet of material 36 to hold the earring. The sheet of material 36 may be any suitable material, including but not limited to: plastic, metal, wood, fiberglass. In one embodiment, the sheet of material 36 may be steel with perforations of about 1/16" diameter in a staggered configuration. One or more wire shelves 22*d* may be used to communicate with one or more necklace hooks 38. There may also be a wall mount 42 attached to each of the vertical members 14. The wall mounts will have at least one hole 46 to allow a user to use one or more screws to firmly attach the jewelry organizer 10 to a wall or door. A decorative member 50 may be attached to one or more of the vertical members 14. One of ordinary skill in the art will recognize that the number and arrangement of the wire shelves 22, hooks and mounts may be altered according to the desire or needs of the user, manufacture or seller, and still be within the scope of this disclosure.

Figure 2:
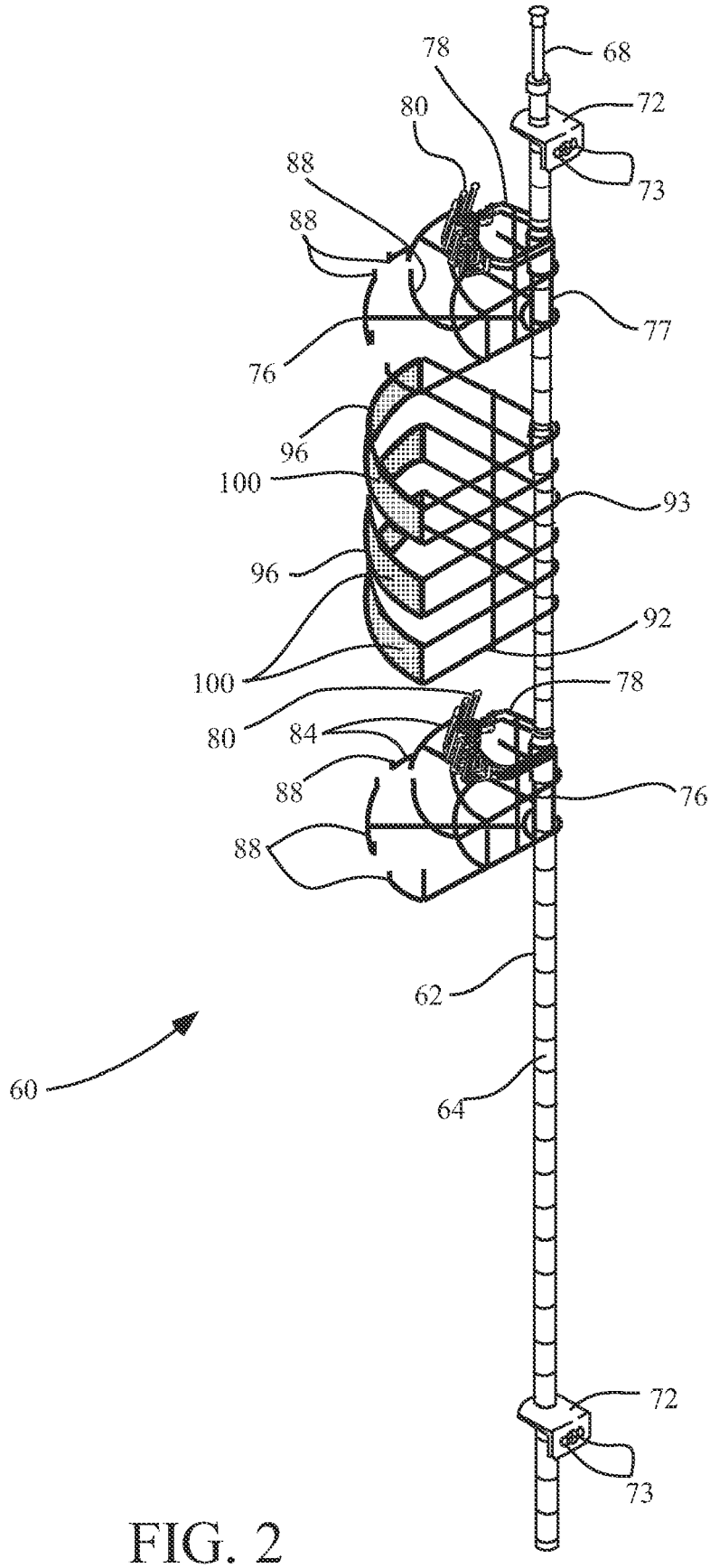
FIG. 2 is a perspective view of another embodiment of the disclosed jewelry organizer.

FIG. 2 shows another embodiment of a jewelry organizer 60. A central member 62 comprises a spring loaded telescoping member 64 and a loaded member 68. The central member 62 is configured to adjust such that the central member 62 can fit, via compression, between a floor and ceiling of various rooms with different ceiling heights. A plurality of optional wall mounts 72 may be in communication with the central member 62. The wall mounts 72 have a plurality of holes 73 to allow a user to attach the wall mounts to a wall or a door via screws. In communication with the central member 62 is a first wire rack assembly 76. The first wire rack assembly 76 comprises a wire rack vertical member 77, at least one ring/broach shelf 78 in communication with the wire rack vertical member 77 and a plurality ring/broach hooks 80, at least one bracelet hook 84 in communication with the wire rack vertical member 77, and at least one necklace hook 88 in communication with the wire rack vertical member 77. Also in communication with the central member 62 is an earring rack 92. The earring rack 92 comprises one or more earring mounts 96 (three earring mounts 96 are shown in this embodiment). Each earring mount 96 comprises a earring mount vertical member 97, and a sheet of material 100 with perforations in communication with the earring mount vertical member 97. Thus a user can attach her earrings to the earring mount 96 by inserting the post of an earring into a perforation, and attaching the back of the earring to the post, thus allowing the sheet of material 100 to hold the earring. A hanging earring may also be attached to the earring mount 96. The sheet of material 100 may be any suitable material, including but not limited to: plastic, metal, wood, fiberglass. In one embodiment, the sheet of material 100 may be steel with perforations of about 1/16" diameter in a staggered configuration. A second wire rack assembly 76 is also in communication with the central member 62. One of ordinary skill in the art will recognize that the number and arrangement of the wire racks and earring racks may be altered according to the desire or needs of the user, manufacture or seller, and still be within the scope of this disclosure. The unique "pie slice" shape of the racks 76, 92 allow the product to be located in a corner of a room.

Figure 3:
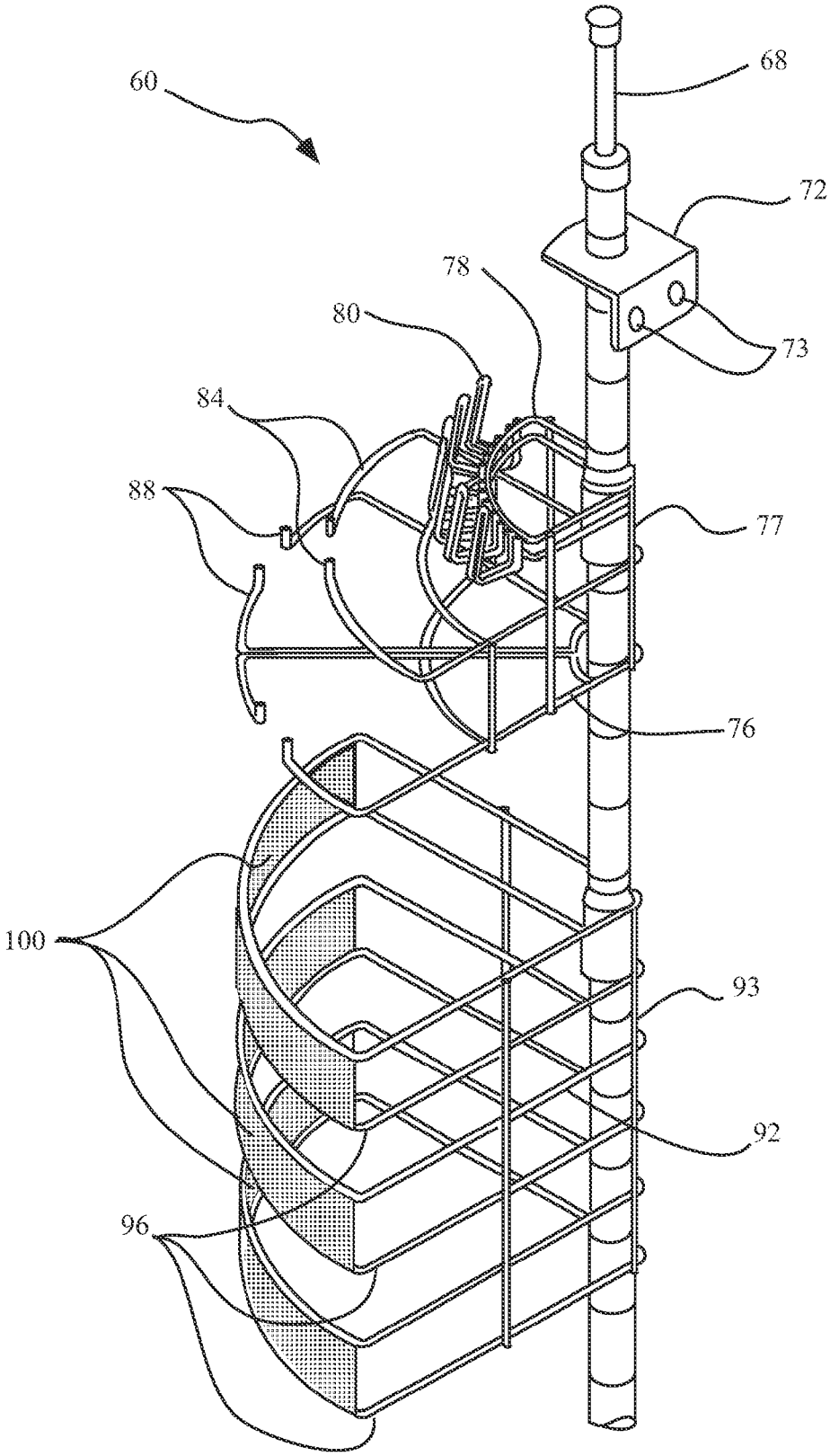
FIG. 3 is a close-up view of the jewelry organizer from FIG. 2.

FIG. 3 shows a close up view of an upper portion of the jewelry organizer 60, the first wire rack assembly 76, and earring rack 92.

Figure 4:
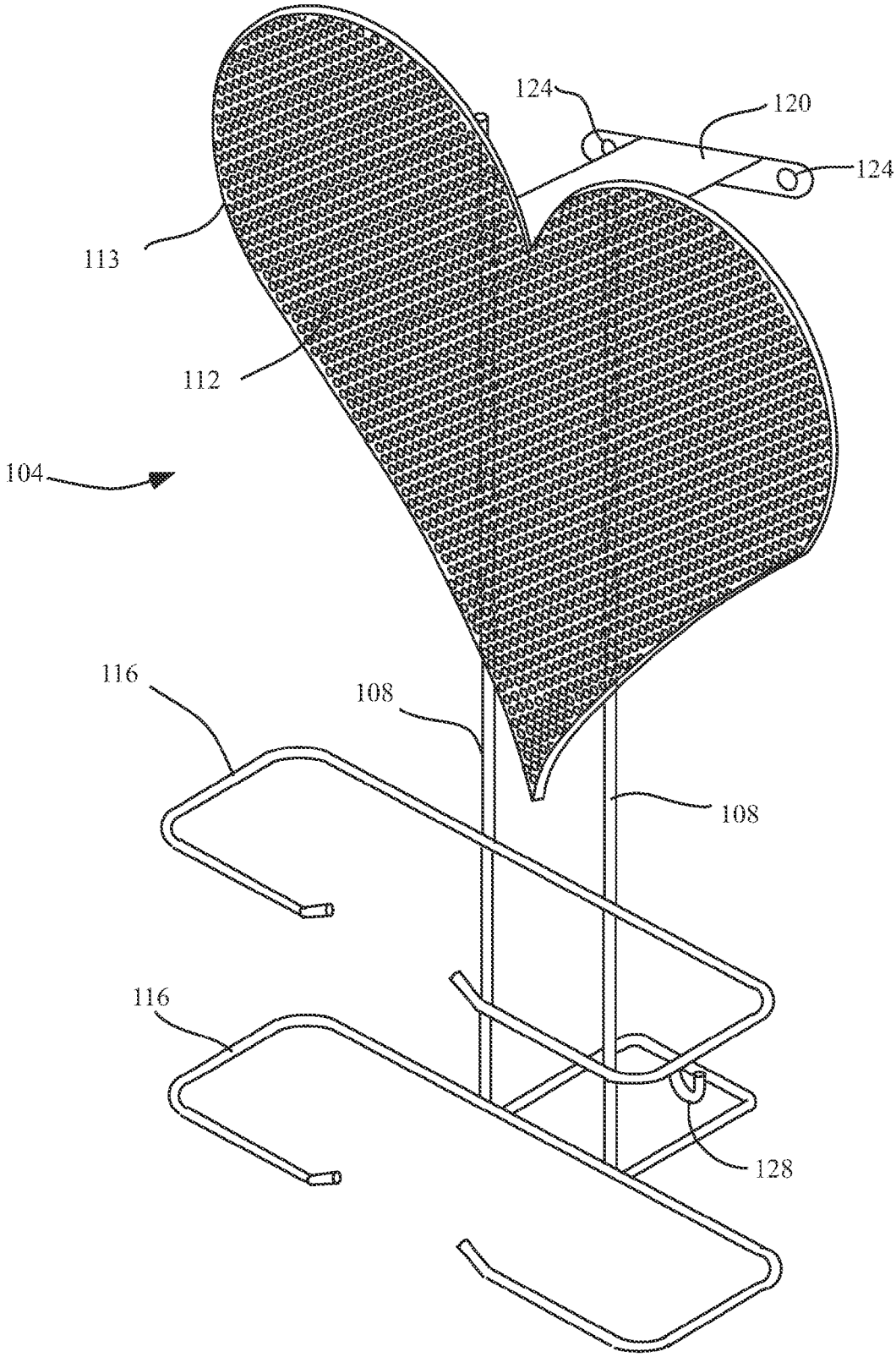
FIG. 4 is a perspective view of another embodiment of the disclosed jewelry organizer.

FIG. 4 shows another embodiment of the jewelry organizer 104. The jewelry organizer 104 comprises at least one vertical member 108 in communication with a heart shaped earring mount 112. The earring mount comprises a heart shaped sheet of material 113 with perforations. Thus a user can attach her earrings to the earring mount by inserting the post of an earring into a perforation, and attaching the back of the earring to the post, thus allowing the sheet of material 113 to hold the earring. The sheet of material 113 may be any suitable material, including but not limited to: plastic, metal, wood, fiberglass. In one embodiment, the sheet of material 113 may be steel with perforations of about 1/16" diameter in a staggered configuration. At least one necklace/bracelet hook 116 is also in communication with the at least one vertical member 108. An upper wall mount 120 is in communication with the at least one vertical member 108. The wall mount may have a plurality of holes 124 to allow a user to use screws or nails to attach the wall mount to a vertical surface such as a wall or a door. A lower wall mount 128 is in communication with the at least one vertical member, and is configured to accept a nail or screw to attach the lower wall mount to a vertical surface such as a wall or door.

Figure 5:
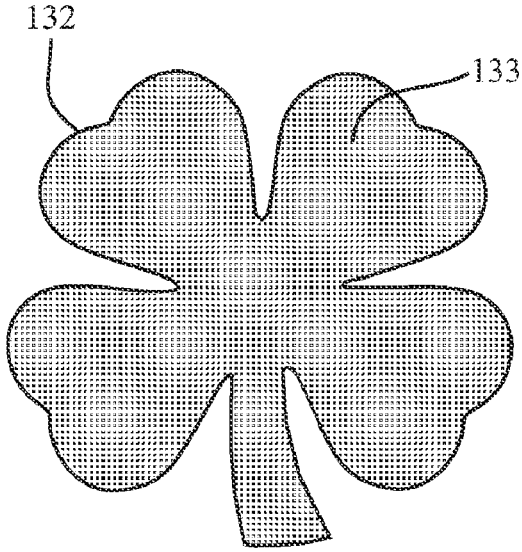
FIG. 5 is a front view of another fanciful shape for the jewelry organizer of FIG. 4.
Figure 6:
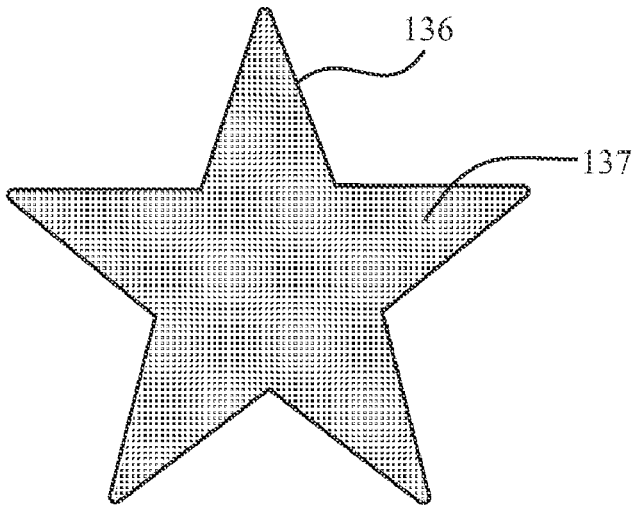
FIG. 6 is a front view of another fanciful shape for the jewelry organizer of FIG. 4.

The jewelry organizer 104 is not limited to just a heart shaped earring mount. Other shapes for earring mounts may be used. FIG. 5 shows a clover shaped earring mount 132, and FIG. 6 shows a star shaped earring mount 136. The clover shaped earring mount 132 comprises a clover shaped sheet of material 133 with perforations. The star shaped earring mount 136 comprises a star shaped sheet of material 137. The sheet of material 133 or 137 may be any suitable material, including but not limited to: plastic, metal, wood, fiberglass. In one embodiment, the sheet of material 133 or 137 may be steel with perforations of about 1/16" diameter in a staggered configuration. It should be noted that the jewelry organizer 104 is not limited to the heart, clover or star shapes.

The disclosed jewelry organizer has many advantages. The disclosed jewelry organizer provides easy accessibility to earrings, bracelets, watches, pins, rings, necklaces and other jewelry. The entire jewelry collection of a user or family may be displayed. The jewelry organizer can be mounted on a wall, on a door, on a table top, or in a corner of a room. The jewelry organizer may be adjustable to a person's height.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A jewelry organizer comprising:

two vertical members;

a plurality of wire shelves in communication with the two vertical members;

a plurality of ring/broach hooks in communication with at least one of the plurality of wire shelves, each ring/broach hook comprising:

a generally vertical member attached to and extending downwardly from a wire shelf, a generally horizontal member extending from the generally vertical member, an acute member extending upwardly at an acute angle from the horizontal member, a plurality of bracelet hooks in communication with at least one of the plurality of wire shelves, each bracelet hook comprising:

a generally horizontal bracelet hook member, the largest cross-sectional dimension of the generally horizontal bracelet hook member is less than about 0.3 inches;

an obtuse member, extending at an obtuse angle from the generally horizontal bracelet hook member, and an earring mount in communication with at least one of the plurality of wire shelves, the earring mount comprising:

a sheet of material;

a plurality of perforations located in the sheet of material.

2. The jewelry organizer of claim 1, wherein the sheet of material with perforations is steel with perforations of about 1/16" diameter in a staggered configuration.

3. The jewelry organizer of claim 1, further comprising:

a plurality of door hooks in communication with the two vertical members.

4. The jewelry organizer of claim 3, wherein the door hooks are configured to slide over the top of a door.

5. The jewelry organizer of claim 1, further comprising:

a plurality of wall mounts in communication with the two vertical members; and wherein wall mounts are configured to attach to a vertical surface.

6. A jewelry organizer comprising:

a central member comprising:

a spring loaded telescoping member;

a loaded member;

a wire rack assembly in communication with the central member, the wire rack assembly comprising:

a wire rack vertical member;

at least one ring/broach shelf in communication with the wire rack vertical member;

a plurality ring/broach hooks in communication with the at least one ring/broach shelf, each ring/broach hook comprising:

a generally vertical member attached to and extending downwardly from a ring/broach shelf, a generally horizontal member extending from the generally vertical member, an acute member extending upwardly at an acute angle from the horizontal member, a necklace hook in communication with the wire rack vertical member, each necklace hook comprising:

a generally horizontal necklace hook member, an obtuse member, extending at an obtuse angle from the generally horizontal necklace hook member; and an earring rack assembly in communication with the central member, the earring rack comprising:

at least one earring mount, the at least one earring mount comprising:

an earring mount vertical member; and a sheet of material with perforations in communication with the earring mount vertical member.

7. The jewelry organizer of claim 6, further comprising:

a plurality of wall mounts in communication with the central member, the plurality of wall mounts configured to be attachable to a vertical surface.

* * * * *